US006434437B1

(12) United States Patent
Brandt et al.

(10) Patent No.: US 6,434,437 B1
(45) Date of Patent: Aug. 13, 2002

(54) BOOM EXTENSION AND BOOM ANGLE CONTROL FOR A MACHINE

(75) Inventors: Everett G. Brandt, Brimfield; Brian D. Rockwood, Washington; Stephen T. Tady, Dekalb, all of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/453,243

(22) Filed: Dec. 2, 1999

(51) Int. Cl.[7] ..... B66F 9/24

(52) U.S. Cl. ..... 700/69; 700/63; 701/50; 212/349; 212/347

(58) Field of Search ..... 700/63, 69–70, 700/85, 61, 65; 701/50; 239/159, 165; 137/355.24; 212/199–204, 347–349; 414/231, 338, 337

(56) References Cited

U.S. PATENT DOCUMENTS

| | | | | |
|---|---|---|---|---|
| 4,594,671 A | * | 6/1986 | Sugimoto et al. | 318/568.18 |
| 4,712,376 A | | 12/1987 | Hadank et al. | 60/427 |
| 4,722,044 A | | 1/1988 | Heiser et al. | 700/65 |
| 4,760,513 A | | 7/1988 | Edwards | 700/69 |
| 4,910,662 A | | 3/1990 | Heiser et al. | 700/65 |
| 5,160,239 A | | 11/1992 | Allen et al. | 414/699 |
| 5,257,177 A | | 10/1993 | Bach et al. | 700/61 |
| 5,424,623 A | | 6/1995 | Allen et al. | 318/568.18 |
| 5,467,829 A | | 11/1995 | Barton et al. | 172/4.5 |
| 5,550,733 A | * | 8/1996 | Yun et al. | 212/272 |
| 5,704,429 A | * | 1/1998 | Lee et al. | 172/4.5 |
| 5,710,514 A | * | 1/1998 | Crayton et al. | 324/635 |
| 5,768,810 A | * | 6/1998 | Ahn | 37/348 |
| 6,108,948 A | * | 8/2000 | Tozawa et al. | 172/2 |

FOREIGN PATENT DOCUMENTS

| | | |
|---|---|---|
| EP | 0397076 | 11/1990 |
| JP | 10305998 | 11/1998 |
| JP | 11222395 | 8/1999 |

* cited by examiner

*Primary Examiner*—Thomas Black
*Assistant Examiner*—Crystal J Barnes
(74) *Attorney, Agent, or Firm*—Howard & Howard

(57) ABSTRACT

A boom control apparatus and method are disclosed for controlling a boom of a machine. The boom control apparatus includes a boom angle sensor, a boom length sensor, a chassis pitch angle sensor, a chassis roll angle sensor, and a control lever. All of the sensors generate signals associated with the values of their measured parameters. Movement of the control lever along a first axis generates a first pivot velocity signal for a desired pivot velocity of the boom. Movement of the control lever along a second axis generates a first telescoping velocity signal for a desired telescoping velocity of the boom. An electrohydraulic control module detects the signals from the sensors and the control lever. The electrohydraulic control module generates a second pivot velocity signal or a second telescoping velocity signal. The second signals are directly proportional to the first signals and inversely proportional to the signals generated by the sensors. The electrohydraulic control module sends the second signals to an electrohydraulic valve associated either with a boom lift cylinder or a boom telescoping cylinder to effect the desired pivot or telescoping velocity. Thus, the present invention allows for more precise control of the end of a boom when the boom is either extended or elevated.

24 Claims, 2 Drawing Sheets

BOOM EXTENSION AND BOOM ANGLE CONTROL FOR A MACHINE

TECHNICAL FIELD

This invention relates generally to machine booms, and, more particularly to a control for controlling the boom extension velocity and boom elevation velocity.

BACKGROUND ART

Many machines, including, for example, telehandlers, include booms. Generally an implement such as, for example, a bucket, fork tines or basket, is located at the end of the boom for manipulation by the operator. A typical boom can be extended over 20 feet (6.1 meters) and can be elevated up to an angle of approximately 80 degrees with respect to the machine.

In a typical machine the raising and lowering of the boom is accomplished by a hydraulic boom lift cylinder. Extension and retraction of the boom is accomplished by a hydraulic boom telescoping cylinder. An operator control lever is moved along a first axis to raise or lower the boom, and along a second axis to extend or retract the boom. The velocity of raising or lowering the boom and the velocity of extending or retracting the boom is controlled by the amount of displacement of the control lever from a reference position. One difficulty with present boom controls is that as the boom is either extended or elevated relative to the machine it becomes very difficult for the operator to precisely control movement of the end of the boom in space.

Thus, it would be desirable to provide a boom extension and boom angle control that permitted a more precise control of the end of the boom as the boom was extended and/or as the boom was elevated relative to the machine. It would be especially desirable if the increase in control were accomplished without need for the operator to manipulate controls other than the control lever.

The present invention is directed to overcome one or more of the problems as set forth above.

DISCLOSURE OF THE INVENTION

In one aspect of this invention, a method for controlling a boom of a machine is disclosed. This method includes the steps of detecting a boom length of a boom on a machine and generating a boom length signal, detecting a boom angle of the boom and generating a boom angle signal, selecting a desired pivot velocity for the boom and transmitting a first pivot velocity signal, detecting the boom length signal, the boom angle signal, and the first pivot velocity signal and generating a second pivot velocity signal, the second pivot velocity signal equal to the sum of a constant and the first pivot velocity signal minus the sum of the boom length signal and the boom angle signal, and pivoting the boom at a pivot velocity associated with the second pivot velocity signal.

In another aspect of the present invention a boom control apparatus is disclosed. The boom control apparatus includes a boom having a boom angle sensor detecting a boom angle and generating a boom angle signal and a boom length sensor detecting a boom length and generating a boom length signal, and the boom pivotable about a pivot point on a machine, a hydraulic boom lift cylinder having a first end attached to the boom and a second end attached to the machine, extension of the boom lift cylinder pivoting the boom upwardly and retraction of the boom lift cylinder pivoting the boom downwardly, a control lever, movement of the control lever from a reference position along a first axis selecting one of a plurality of desired pivot velocities and transmitting a first pivot velocity signal based on the relative displacement of the control lever from the reference position, an electrohydraulic control module, the control module detecting the boom angle signal, the boom length signal, and the first pivot velocity signal, the control module generating a second pivot velocity signal equal to the sum of a constant and the first pivot velocity signal minus the sum of the boom angle signal and the boom length signal, and an electrohydraulic valve, the valve detecting the second pivot velocity signal and adjusting a flow rate of a hydraulic fluid into or out of the boom lift cylinder, the flow rate into or out of the boom lift cylinder pivoting the boom at a pivot velocity associated with the second pivot velocity signal.

BEST MODE FOR CARRYING OUT THE INVENTION

Figure 1:
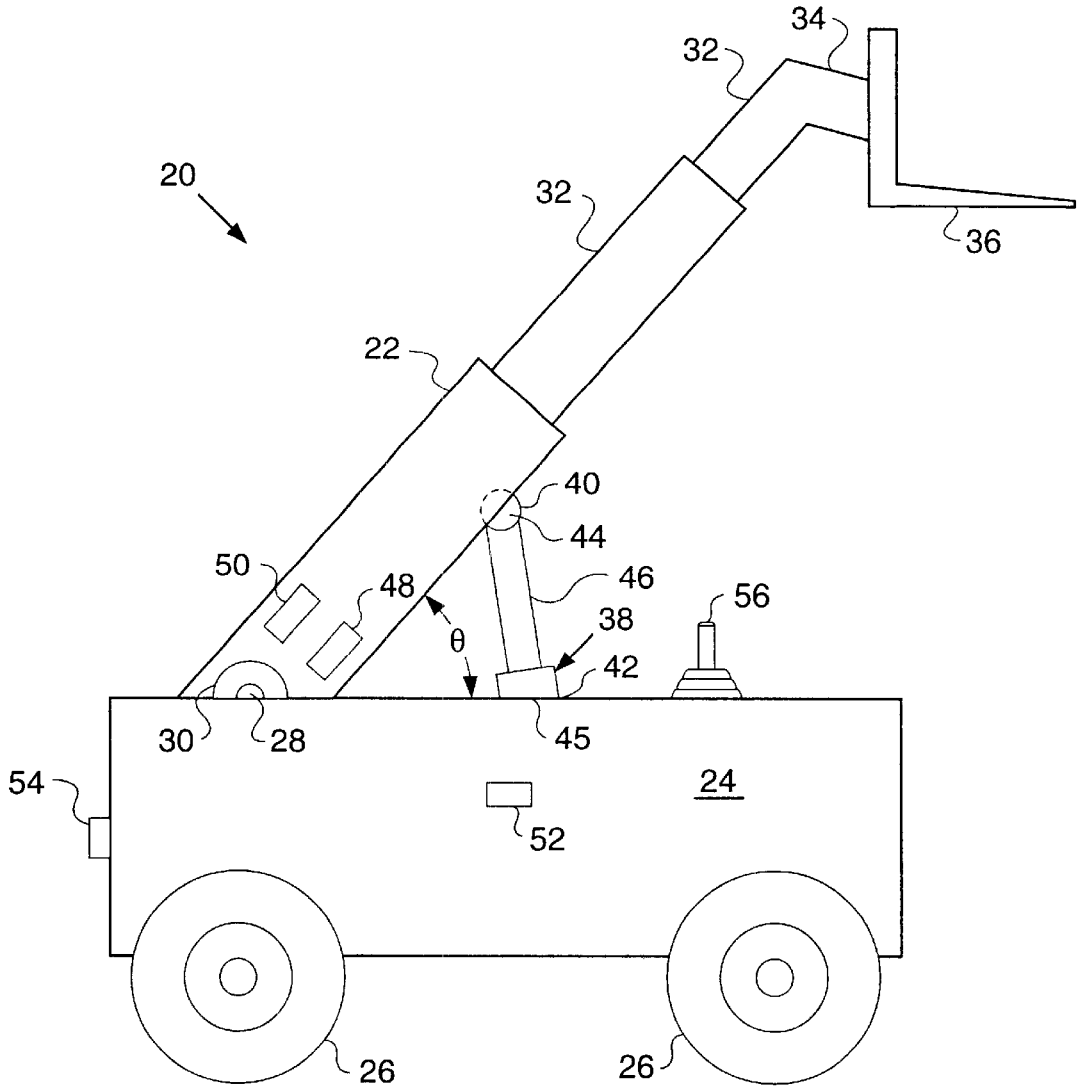
FIG. 1 is a side elevation of a machine having a boom and incorporating a boom control apparatus designed according to the present invention.

In FIG. 1, a machine is shown generally at 20. Machine 20 includes a boom 22 and is shown as a telehandler, but as would be understood by one of ordinary skill in the art, machine 20 could be any machine with a boom 22. Machine 20 includes a frame 24 supported on a plurality of ground wheels 26. Boom 22 is pivotally attached to a pivot point 28 on machine 20 by a bracket 30 as is known in the art. Boom 22 can telescope between a retracted position and a fully extended position as shown in FIG. 1. To permit telescoping boom 22 includes a hydraulic boom telescoping cylinder 72 (see FIG. 2) and a plurality of boom extensions 32 as is known in the art. Boom 22 includes a distal end 34 to which an implement can be mounted. Distal end 34 is shown with a pair of fork tines 36 attached to it. As is known in the art, boom 22 can accommodate other implements such as, for example, a scoop or a cherry picker type bucket. Boom 22 makes a boom angle of $\theta$ with the machine 20. As boom 22 is raised boom angle $\theta$ is increased.

A hydraulic boom lift cylinder 38 includes a first end 40 opposite a second end 42. The first end 40 attaches to the boom 22 at a cylinder attachment point 44. The second end 42 attaches to an attachment point 45 on the machine 20. Cylinder 38 is of a typical design and includes a piston 46 that is movable into and out of the cylinder 38. Movement of piston 46 out of cylinder 38 raises boom 22 thereby increasing the boom angle $\theta$, retraction of the piston 46 lowers the boom 22 and decreases the boom angle $\theta$.

Machine 20 further includes a boom angle sensor 48 mounted on boom 22. Boom angle sensor 48 detects the boom angle $\theta$ and generates a boom angle signal. A boom length sensor 50 mounted to boom 22 detects the boom length of boom 22 and generates a boom length signal. Machine 20 further includes a chassis pitch angle sensor 52 which detects the up and down pitch of machine 20 relative to a horizontal. A chassis roll angle sensor 54 detects the sideways angle of the machine 20 relative to a horizontal. In other words, the angle relative to a horizontal along one of the axles of either the front ground wheels 26 or the rear ground wheels 26.

Machine 20 includes an operator control lever 56. Movement of the operator control lever 56 from a reference position a first direction along a first axis 68 (see FIG. 2) selects a desired pivot velocity and generates a first pivot velocity signal for one of raising or lowering the boom 22. Movement of the operator control lever 56 from the reference position a second direction opposite the first direction along the first axis 68 (see FIG. 2) selects a desired pivot velocity and generates a first pivot velocity for the other one of raising or lowering the boom 22. The relative displacement of the control lever 56 along the first axis 68 from the reference position determines the desired pivot velocity and the magnitude of the first velocity signal, the greater the displacement the greater the desired pivot velocity and first pivot velocity signal. The polarity of the velocity signal is altered between movement in the first direction and movement in the second direction and this determines whether the signal raises or lowers the boom 22.

Movement of the operator control lever 56 from the reference position a first direction along a second axis 70 (see FIG. 2) selects a desired telescoping velocity and generates a first telescoping velocity signal for one of extending or retracting the boom 22. Movement of the operator control lever 56 from the reference position a second direction opposite the first direction along the second axis 70 (see FIG. 2) selects a desired telescoping velocity and generates a first telescoping velocity signal for the other one of extending or retracting the boom 22. The relative displacement of the control lever 56 along the second axis 70 from the reference position determines the desired telescoping velocity and the magnitude of the first telescoping velocity signal, the greater the displacement the greater the desired telescoping velocity. The polarity of the velocity signal is altered between movement in the first direction and movement in the second direction and this determines whether the signal extends or retracts the boom 22.

A toggle switch (not shown) permits movement along the second axis 70 to also control movement of the implement at the distal end 34 of boom 22, as is known in the art. The maximal velocity of the boom lift cylinder 38 and boom telescoping cylinder 72 of the present invention are determined by the engine speed of machine 20, as is known in the art.

Figure 2:
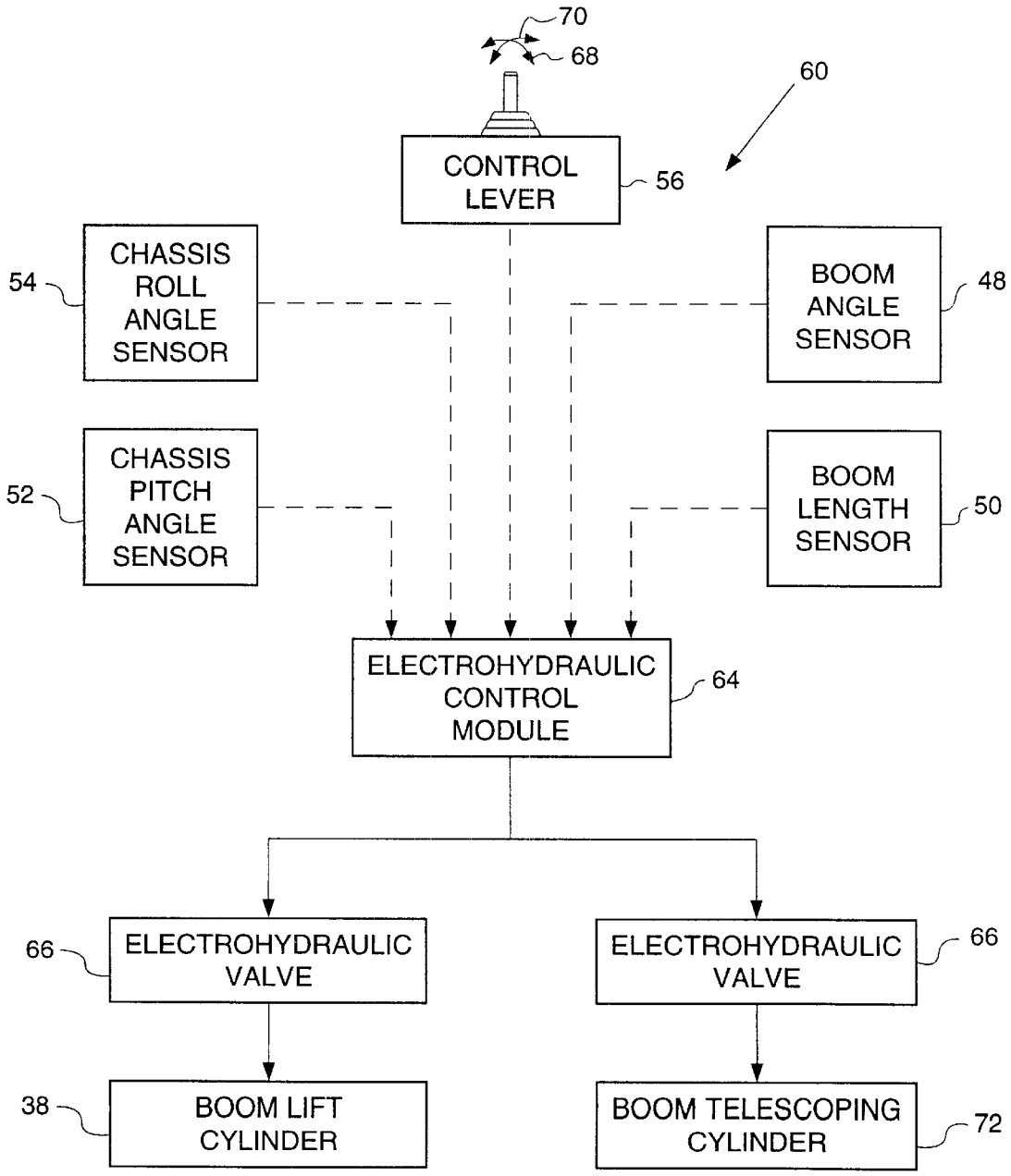
FIG. 2 is a schematic diagram of the boom control apparatus of the present invention.

In FIG. 2, a boom control apparatus designed according to the present invention is shown generally at 60. Boom control apparatus 60 includes an electrohydraulic control module 64 and a plurality of electrohydraulic valves 66. One of the electrohydraulic valves 66 is associated with the boom lift cylinder 38, another of the electrohydraulic valves 66 is associated with the boom telescoping cylinder 72. The control module 64 detects the signals from the control lever 56, the boom angle sensor 48, the boom length sensor 50, chassis pitch angle sensor 52, and chassis roll angle sensor 54.

As discussed above, movement of control lever 56 along first axis 68 selects a desired pivot velocity. Control lever 56 then transmits a first pivot velocity signal based on the relative displacement of control lever 56 from the reference position to control module 64. Based on the following series of equations the control module 64 generates a second pivot velocity signal which is sent to the electrohydraulic control valve 66.

First, the control module 64 calculates a boom pivot current adjustment (i1) based on the extension and elevation of the boom using the following equation:

$$i1=(k1)(X)+(k2)(Y)$$

The variables have the following definitions: k1 is the boom length pivot gain; X is the boom length; k2 is the boom angle pivot gain; and Y is the boom angle. The variables k1 and k2 may be either fixed or they may vary with the vales of X and Y, respectively. In addition, k1 and k2 may have the same or different values. Thus, as either the boom length or boom angle increase, the value of i1 increases.

Second, the control module 64 calculates the second pivot velocity signal (ib) using the following equation:

$$ib=io+id-i1$$

The variables have the following definitions: io is the first pivot velocity signal; id is the deadband current requirement necessary to open the electrohydraulic valve 66; and i1 is defined above. The control module 64 then sends the second pivot velocity signal having a current value of ib to the electrohydraulic valve 66 associated with the boom lift cylinder 38 which pivots the boom 22 at the pivot velocity associated with the second pivot velocity signal. Thus, as the boom 22 is elevated or extended, the signal ib sent to the electrohydraulic control valve 66 is reduced permitting the operator to exert better control over the end of the boom 22.

The control module 64 also receives the signals from the chassis pitch angle sensor 52 and chassis roll angle sensor 54. When these two variables are monitored the boom current adjustment (i1) is calculated as follows:

$$i1=(k1)(X)+(k2)(Y)+(k5)(PA)+(k6)(RA)$$

The variables have the following definitions: k1 is the boom length pivot gain; X is the boom length; k2 is the boom angle pivot gain; Y is the boom angle; k5 is the pitch angle gain; PA is the pitch angle; k6 is the roll angle gain; and RA is the roll angle. Similar to k1 and k2, the variables k5 and k6 may be either fixed or they may vary with the values of PA and RA, respectively. In addition, k5 and k6 may have the same or different values. Thus, as either the pitch angle or roll angle increase, the value of i1 increases. The larger the values of PA and RA the more unstable the machine 20 is.

Control of the telescoping velocity is achieved in a similar manner. Specifically, movement of control lever 56 along second axis 70 selects a desired telescoping velocity. Control lever 56 generates a first telescoping velocity signal, which is detected by the control module 64. Based on the following series of equations the control module 64 generates a second telescoping velocity signal, which is sent to the electrohydraulic control valve 66 associated with the boom telescoping cylinder 72.

First, the control module 64 calculates a boom telescoping current adjustment (i2) based on the extension and elevation of the boom using the following equation:

$$i2=(k3)(X)+(k4)(Y)$$

The variables have the following definitions: k3 is the boom length telescoping gain; X is the boom length; k4 is the boom angle telescoping gain; and Y is the boom angle. The variables k3 and k4 may be either fixed or they may vary with the values of X and Y, respectively. In addition, k3 and k4 may have the same or different values. Thus, as either the boom length or boom angle increase, the value of i2 increases.

Second, the control module 64 calculates the second telescoping velocity signal (it) using the following equation:

$$it=ia+id-i2$$

The variables have the following definitions: io is the first telescoping velocity signal; id is the deadband current requirement necessary to open the electrohydraulic valve 66; and i2 is defined above. The control module 64 then sends the second telescoping velocity signal having a current value of it to the electrohydraulic valve 66 associated with the boom telescoping cylinder 72 which telescopes the boom 22 at the telescoping velocity associated with the second telescoping velocity signal. Thus, as the boom 22 is elevated or extended, the signal it sent to the electrohydraulic control valve 66 is reduced permitting the operator to exert better control over the end of the boom 22.

Similarly, the control module 64 receives the signals from the chassis pitch angle sensor 52 and chassis roll angle sensor 54. When these two variables are monitored the boom telescoping current adjustment (i2) is calculated as follows:

$$i2=(k3)(X)+(k4)(Y)+(k5)(PA)+(k6)(RA)$$

The variables have the following definitions: k3 is the boom length telescoping gain; X is the boom length; k4 is the boom angle telescoping gain; Y is the boom angle; k5 is the pitch angle gain; PA is the pitch angle; k6 is the roll angle gain; and RA is the roll angle. Similar to k3 and k4, the variables k5 and k6 may be either fixed or they may vary with the values of PA and RA, respectively. In addition, k5 and k6 may have the same or different values. Thus, as either the pitch angle or roll angle increase, the value of i2 increases. The larger the values of PA and RA the more unstable the machine 20 is. of course, various modifications of this invention would come within the scope of the invention.

INDUSTRIAL APPLICABILITY

The present invention discloses a method and apparatus for controlling the speed of extension of a boom 22 and the speed of changing the elevation of the boom 22. The boom control apparatus 60 is applicable to any of a variety of machines 20 that include a boom 22. An operator control lever 56 is movable from a reference position along at least a first axis 68 and a second axis 70. Movement of control lever 56 along first axis 68 controls the pivot velocity of raising or lowering the boom 22. Movement of control lever 56 along second axis 70 controls the telescoping velocity of boom 22. Movement of the control lever 56 relative to a reference position determines the magnitude of the desired velocity for either pivoting or telescoping the boom 22. Movement of control lever 56 generates either a first pivot velocity signal or a first telescoping velocity signal. Boom control apparatus 60 further includes an electrohydraulic control module 64 that detects signals from a boom angle sensor 48, a boom length sensor 50, a chassis pitch angle sensor 52, and a chassis roll angle sensor 54 in addition to the signals from control lever 56. The control module 64 uses the signals detected from these sensors and the control lever 56 to generate a second pivot velocity signal or a second telescoping velocity signal. The second pivot velocity signal is sent to the electrohydraulic valve 66 associated with the boom lift cylinder 38 to pivot the boom 22. The second telescoping velocity signal is sent to the electrohydraulic valve 66 associated with the boom telescoping cylinder 72 to extend or retract the boom 22. The second velocity signals are directly. proportional to the first velocity signals and inversely proportional to the signals detected from the boom angle sensor 48, boom length sensor 50, chassis pitch angle sensor 52 and chassis roll angle sensor 54. Thus, the operator is better able to control the boom 22 as it is elevated, extended, or the machine is unstable.

Other aspects, objects and advantages of this invention can be obtained from a study of the drawings, the disclosure and the appended claims.

What is claimed is:

1. A method for controlling a boom of a machine comprising the steps of:

detecting a boom length of a boom on a machine and generating a boom length signal;

detecting a boom angle of said boom and generating a boom angle signal;

selecting a desired pivot velocity for said boom and transmitting a first pivot velocity signal;

detecting said boom length signal, said boom angle signal, and said first pivot velocity signal and generating a second pivot velocity signal, said second pivot velocity signal equal to the sum of a constant and said first pivot velocity signal minus the sum of said boom length signal and said boom angle signal; and pivoting said boom at a pivot velocity associated with said second pivot velocity signal.

2. The method as recited in claim 1, wherein the step of selecting a desired pivot velocity for said boom and transmitting a first pivot velocity signal includes the further steps of selecting said desired pivot velocity by moving a control lever from a reference position along a first axis, said desired pivot velocity and the magnitude of said first pivot velocity signal based on the relative displacement of said control lever from said reference position.

3. The method as recited in claim 2, wherein the step of pivoting said boom at a pivot velocity associated with said second pivot velocity signal further includes pivoting said boom in a first pivot direction in response to moving said control lever in a first direction along said first axis and pivoting said boom in a second pivot direction opposite said first pivot direction in response to moving said control lever in a second direction opposite said first direction along said first axis.

4. The method as recited in claim 1, including the further step of detecting a chassis roll angle of said machine and generating a chassis roll angle signal, and the step of detecting said boom length signal, said boom angle signal, and said first pivot velocity signal and generating a second pivot velocity signal, said second pivot velocity signal equal to the sum of a constant and said first pivot velocity signal minus the sum of said boom length signal and said boom angle signal further includes detecting said chassis roll angle signal and generating said second pivot velocity signal equal to the sum of said constant and said first pivot velocity signal minus the sum of said boom length signal, said boom angle signal, and said chassis roll angle signal.

5. The method as recited in claim 1, including the further step of detecting a chassis pitch angle of said machine and generating a chassis pitch angle signal, and the step of detecting said boom length signal, said boom angle signal, and said first pivot velocity signal and generating a second pivot velocity signal, said second pivot velocity signal equal to the sum of a constant and said first pivot velocity signal minus the sum of said boom length signal and said boom angle signal further includes detecting said chassis pitch angle signal and generating said second pivot velocity signal equal to the sum of said constant and said first pivot velocity signal minus the sum of said boom length signal, said boom angle signal, and said chassis pitch angle signal.

6. The method as recited in claim 1, wherein transmitting said pivot velocity signal in the step of selecting a desired pivot velocity for said boom and transmitting a first pivot velocity signal further includes transmitting one of an electrical signal, a microwave signal, or a radio signal as said pivot velocity signal.

7. The method as recited in claim 1, wherein generating said boom length signal includes calculating the product of a fixed boom length pivot gain and said boom length and transmitting the product and wherein generating said boom angle signal comprises calculating the product of a fixed boom angle pivot gain and said boom angle and transmitting the product.

8. The method as recited in claim 1, wherein generating said boom length signal includes calculating the product of a variable boom length pivot gain and said boom length and transmitting the product and wherein generating said boom angle signal comprises calculating the product of a variable boom angle pivot gain and said boom angle and transmitting the product.

9. A method for controlling a boom of a machine comprising the steps of:

detecting a boom length of a boom on a machine and generating a boom length signal;

detecting a boom angle of said boom and generating a boom angle signal;

selecting a desired telescoping velocity for said boom and transmitting a first telescoping velocity signal;

detecting said boom length signal, said boom angle signal, and said first telescoping velocity signal and generating a second telescoping velocity signal, said second telescoping velocity signal equal to the sum of a constant and said first telescoping velocity signal minus the sum of said boom length signal and said boom angle signal; and telescoping said boom at a telescoping velocity associated with said second telescoping velocity signal.

10. The method as recited in claim 9, wherein the step of selecting a desired telescoping velocity for said boom and transmitting a first telescoping velocity signal includes the further steps of selecting said desired telescoping velocity by moving a control lever from a reference position along a second axis, said desired telescoping velocity and the magnitude of said first telescoping velocity signal based on the relative displacement of said control lever from said reference position.

11. The method as recited in claim 10, wherein the step of detecting said boom length signal, said boom angle signal, and said first telescoping velocity signal and generating a second telescoping velocity signal, said second telescoping velocity signal equal to the sum of a constant and said first telescoping velocity signal minus the sum of said boom length signal and said boom angle signal and the step of telescoping said boom at a telescoping velocity associated with said second telescoping velocity signal further includes telescoping said boom in a first telescoping direction in response to moving said control lever in a first direction along said second axis and telescoping said boom in a second telescoping direction opposite said first telescoping direction in response to moving said control lever in a second direction opposite said first direction along said second axis.

12. The method as recited in claim 9, including the further step of detecting a chassis roll angle of said machine and generating a chassis roll angle signal, and the step of detecting said boom length signal, said boom angle signal, and said first telescoping velocity signal and generating a second telescoping velocity signal, said second telescoping velocity signal equal to the sum of a constant and said first telescoping velocity signal minus the sum of said boom length signal and said boom angle signal further includes detecting said chassis roll angle signal and generating said second pivot velocity signal equal to the sum of said constant and said first pivot velocity signal minus the sum of said boom length signal, said boom angle signal, and said chassis roll angle signal.

13. The method as recited in claim 9, including the further step of detecting a chassis pitch angle of said machine and generating a chassis pitch angle signal, and the step of detecting said boom length signal, said boom angle signal, and said first telescoping velocity signal and generating a second telescoping velocity signal, said second telescoping velocity signal equal to the sum of a constant and said first telescoping velocity signal minus the sum of said boom length signal and said boom angle signal further includes detecting said chassis pitch angle signal and generating said second pivot velocity signal equal to the sum of said constant and said first pivot velocity signal minus the sum of said boom length signal, said boom angle signal, and said chassis pitch angle signal.

14. The method as recited in claim 9, wherein transmitting said telescoping velocity signal in the step of selecting a desired telescoping velocity for said boom and transmitting a first telescoping velocity signal further includes transmitting one of an electrical signal, a microwave signal, or a radio signal as said telescoping velocity signal.

15. The method as recited in claim 9, wherein generating said boom length signal includes calculating the product of a fixed boom length telescoping gain and said boom length and transmitting the product and wherein generating said boom angle signal includes calculating the product of a fixed boom angle telescoping gain and said boom angle and transmitting the product.

16. The method as recited in claim 9, wherein generating said boom length signal includes calculating the product of a variable boom length telescoping gain and said boom length and transmitting the product and wherein generating said boom angle signal includes calculating the product of a variable boom angle telescoping gain and said boom angle and transmitting the product.

17. A boom control apparatus comprising:

a boom having a boom angle sensor detecting a boom angle and generating a boom angle signal and a boom length sensor detecting a boom length and generating a boom length signal, and said boom pivotable about a pivot point on a machine;

a hydraulic boom lift cylinder having a first end attached to said boom and a second end attached to said machine, extension of said boom lift cylinder pivoting said boom upwardly and retraction of said boom lift cylinder pivoting said boom downwardly;

a control lever, movement of said control lever from a reference position along a first axis selecting one of a plurality of desired pivot velocities and transmitting a first pivot velocity signal based on the relative displacement of said control lever from said reference position;

an electrohydraulic control module, said control module detecting said boom angle signal, said boom length signal, and said first pivot velocity signal, said control module generating a second pivot velocity signal equal to the sum of a constant and said first pivot velocity signal minus the sum of said boom angle signal and said boom length signal; and an electrohydraulic valve, said valve detecting said second pivot velocity signal and adjusting a flow rate of a hydraulic fluid into or out of said boom lift cylinder, said flow rate into or out of said boom lift cylinder pivoting said boom at a pivot velocity associated with said second pivot velocity signal.

18. The boom control apparatus as recited in claim 17, wherein movement of said control lever along said first axis in a first direction pivots said boom upwardly and movement of said control lever along said first axis in a second direction opposite said first direction pivots said boom downwardly.

19. The boom control apparatus as recited in claim 17, further including a chassis roll angle sensor, said sensor detecting the chassis roll angle and generating a chassis roll angle signal; said electrohydraulic control module detecting said chassis roll angle signal and generating said second pivot velocity signal equal to the sum of said constant and said first pivot velocity signal minus the sum of said boom length signal, said boom angle signal, and said chassis roll angle signal.

20. The boom control apparatus as recited in claim 17, further including a chassis pitch angle sensor, said sensor detecting the chassis pitch angle and generating a chassis pitch angle signal; said .electrohydraulic control module detecting said chassis pitch angle signal and generating said second pivot velocity signal equal to the sum of said constant and said first pivot velocity signal minus the sum of said boom length signal, said boom angle signal, and said chassis pitch angle signal.

21. The boom control apparatus as recited in claim 17, further comprising:

a hydraulic boom telescoping cylinder, extension of said boom telescoping cylinder extending said boom and retraction of said boom telescoping cylinder retracting said boom;

movement of said control lever from a reference position along a second axis selecting one of a plurality of desired telescoping velocities and transmitting a first telescoping velocity signal said electrohydraulic control module detecting said first telescoping velocity signal and generating a second telescoping velocity signal equal to the sum of a constant and said first telescoping velocity signal minus the sum of said boom angle signal and said boom length signal; and an electrohydraulic valve detecting said second telescoping velocity control signal and adjusting a flow rate of a hydraulic fluid into or out of said boom telescoping cylinder, said flow rate into or out of said boom telescoping cylinder telescoping said boom at a telescoping velocity associated with said second telescoping velocity signal.

22. The boom control apparatus as recited in claim 21, wherein movement of said control lever along said second axis in a first direction extends said boom and movement of said control lever along said second axis in a second direction opposite said first direction retracts said boom.

23. The boom control apparatus as recited in claim 21, further including a chassis roll angle sensor, said sensor detecting the chassis roll angle and generating a chassis roll angle signal; said electrohydraulic control module detecting said chassis roll angle signal and generating said second telescoping velocity signal equal to the sum of said constant and said first telescoping velocity signal minus the sum of said boom length signal, said boom angle signal, and said chassis roll angle signal.

24. The boom control apparatus as recited in claim 21, further including a chassis pitch angle sensor, said sensor detecting the chassis pitch angle and generating a chassis pitch angle signal; said electrohydraulic control module detecting said chassis pitch angle signal and generating said second telescoping velocity signal equal to the sum of said constant and said first telescoping velocity signal minus the sum of said boom length signal, said boom angle signal, and said chassis pitch angle signal.

* * * * *